US005136955A

United States Patent [19]

Resta et al.

[11] Patent Number: 5,136,955

[45] Date of Patent: Aug. 11, 1992

[54] QUILTING APPARATUS

[75] Inventors: Rodolfo Resta; Mario Resta; Roberto Resta, all of Faenza, Italy

[73] Assignee: Resta S.r.l., Faenza, Italy

[21] Appl. No.: 736,533

[22] Filed: Jul. 26, 1991

[30] Foreign Application Priority Data

Aug. 17, 1990 [IT] Italy ..... 3636 A/90

[51] Int. Cl.[5] ..... D05B 11/00; D05B 21/00

[52] U.S. Cl. ..... 112/118; 112/121.14; 112/121.29

[58] Field of Search ..... 112/117, 118, 119, 121.12, 112/121.14, 121.29, 103

[56] References Cited

U.S. PATENT DOCUMENTS 3,382,825 5/1968 Cash ..... 112/117
4,503,789 3/1985 Scholl ..... 112/121.14
4,669,405 6/1987 Resta et al. ..... 112/119 X
4,688,499 8/1987 Moore et al. ..... 112/121.29 X
4,969,410 11/1990 Brower et al. ..... 112/117 X

*Primary Examiner*—Peter Nerbun
*Attorney, Agent, or Firm*—Guido Modiano; Albert Josif

[57] ABSTRACT

The quilting apparatus includes a framework upon which a carriage with sewing head and crochet device is slidingly supported in a first direction. The sewing head and crochet device are slidingly supported in a second direction perpendicular to the first direction on transverse beams of the carriage. The carriage is positionable on a selected one of at least two cloth holding frames carriages with cloth holding clamps, and cloth loading tables, working in synchronization with the sewing carriage to remove and load cloths at the cloth holding frame where quilting is not taking place.

8 Claims, 2 Drawing Sheets

QUILTING APPARATUS

BACKGROUND OF THE INVENTION

The present invention relates to a quilting apparatus for quilting cloths in general.

As known, quilts, eiderdowns and cloths in general are quilted by laying the cloth on a frame which is moved along two orthogonal directions X and Y below a sewing machine.

Alternatively the cloth-holding frame is actuated in the X direction, whereas the sewing machine moves in the Y direction. In a different process, the frame is fixed and the sewing machine moves in both directions X and Y.

In any case, known apparatuses remain idle for all the time during which the quilted cloth must be replaced with a new one, so that in view of the high incidence of this deadtime there is a considerable reduction in the productivity of these apparatus.

SUMMARY OF THE INVENTION

The technical aim of the present invention is to provide an apparatus by means of which the above disadvantages are substantially eliminated.

Within the scope of this aim, an object of the present invention is to provide an apparatus which is structurally simple and thus constructively economical.

This aim and this object are achieved by an apparatus as defined in the appended claims.

BRIEF DESCRIPTION OF THE DRAWINGS

Further characteristics and advantages of the present invention will become apparent from the following description of some embodiments, illustrated only by way of non-limitative example in the accompanying drawings, wherein.

DESCRIPTION OF THE PREFERRED EMBODIMENTS

Figure 1:
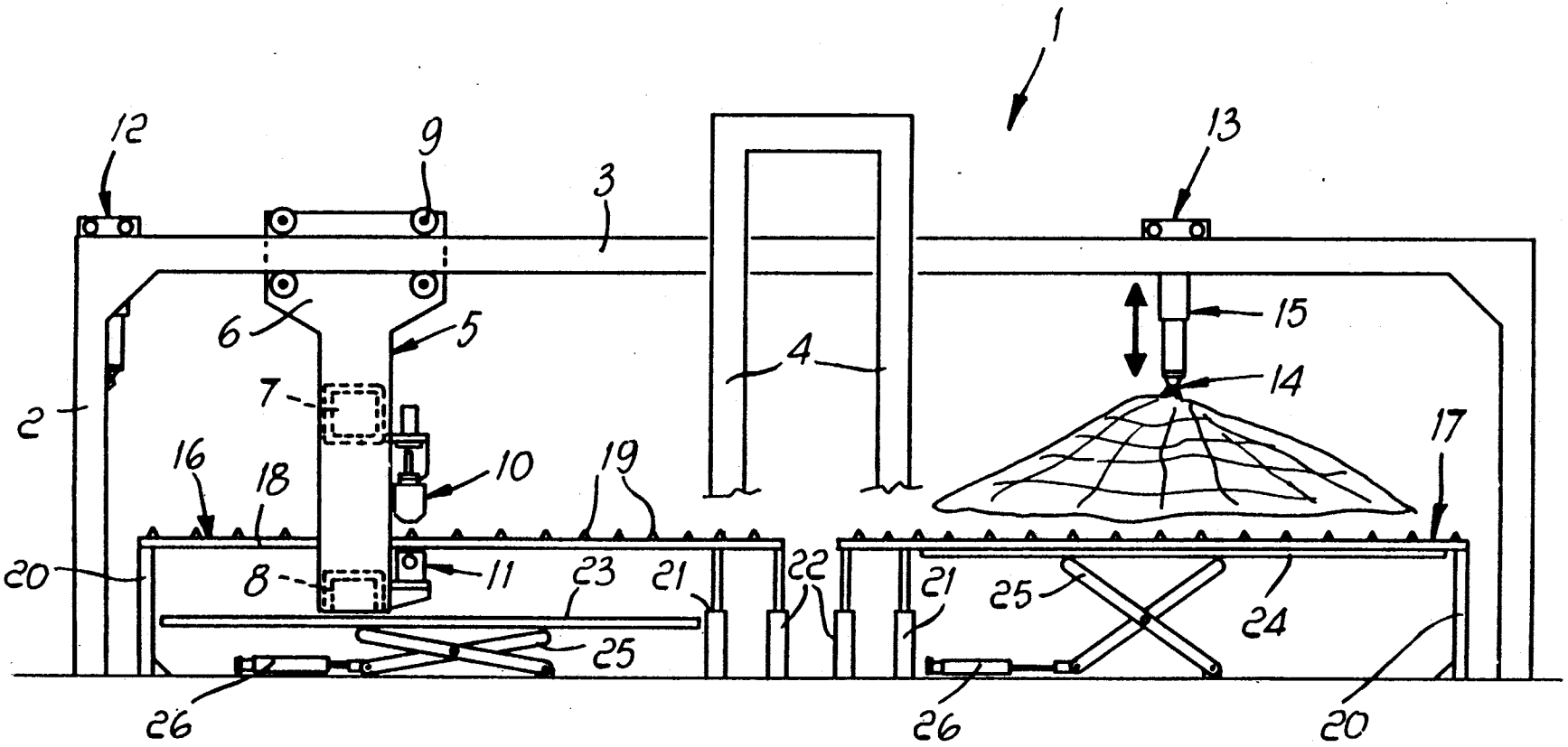
FIG. 1 is a partially schematic side view of a first embodiment of the quilting apparatus according to the present invention.

According to FIG. 1, the illustrated apparatus comprises a framework, generally indicated by 1, which comprises four uprights 2 which are arranged along the vertices of a rectangle and are mutually connected by transverse members which extend along the sides of said rectangle; the longitudinal transverse members, indicated by 3, are visible in the drawing. Said members 3 are supported, in a median position, by a pair of posts 4 to prevent excessive deflection.

The members 3 constitute the guides for a carriage 5 on which one or more sewing heads are mounted.

Said carriage 5 comprises a pair of side walls 6 which are mutually connected by two beams 7, 8 perpendicular to the members 3 and are provided with rollers 9 for sliding on said members in the direction termed X by convention. The carriage 5 preferably has a structure similar to that of the carriage disclosed in U.S. Ser. No. 07/507,556 filed on Apr. 11, 1990, now U.S. Pat. No. 5,103,747 to which reference is made for better understanding of the details.

The beams 7, 8 slidingly support a sewing head 10, and a crochet device 11 which is operatively connected thereto, of the sewing machines, the movement whereof occurs in a transverse direction, i.e. in a direction which is termed Y by convention, by means such as mutually connected threaded rods which can be actuated in both rotational directions by an appropriate gearmotor unit.

Two further carriages 12, 13 are arranged on the members 3 on both sides of the first carriage 5; each comprises a grip element, for example a clamp 14, which is applied to an element 15 which can extend telescopingly in a vertical direction. The carriages 5, 12, 13 are provided with motorization units by means of which they can be moved along the members 3.

In particular, the carriage 5 can move along the entire length of the members 3 so that it can operate on cloths stretched on a pair of cloth-holding frames 16, 17.

Each frame is constituted by two longitudinal strips 18 which are provided, on their upper edge, with means (needles or hooks) 19 for engaging the longitudinal edges of the cloth to be quilted. Preferably, one strip of the frame is fixed, whereas the distance of the other one with respect to the first one can be adjusted so as to be able to adapt the dimensions of the frame to those of the cloth to be quilted. The frames 16, 17 are supported by fixed legs 20 at the end proximate to the uprights 2 of the frame and by pairs of jacks 21, 22 at the end proximate to the post 4. The height of the legs 20 and of the jacks 21, 22 is such that the frames 16, 17 extend at a level which is intermediate between the sewing heads 10 and the crochet devices 11.

Two tables 23, 24 are arranged below the frames 16, 17 and can be actuated between a raised position, in which they are substantially co-planar with the frames 16, 17, and a lowered position below the carriage 5.

The tables 23, 24 have the function of supporting the cloth during the step of application to the frames 16, 17, and are raised and lowered by means of respective pantograph systems 25 actuated by jacks 26.

The operation of the described apparatus is as follows.

Assume the apparatus is in the condition illustrated in FIG. 1, in which the carriage 5, on which the sewing machines are mounted, operates on the cloth stretched on the frame 16.

The previously quilted cloth is removed by means of the grip element 14 of the carriage 13, which grips it and, after lifting and separating it from the means 19 of the frame 17, moves it away by shifting toward the rightward end of the members 3.

While the carriage 5 completes the quilting of the cloth stretched on the frame 16, the table 24 is lowered, and a new cloth to be quilted is placed thereon; said cloth is raised, by the lifting of the table 24, to the level of the frame 17 and is manually applied thereto. The frame 24 is then lowered again to a level below the carriage 5. In this manner, when the quilting of the cloth stretched on the frame 16 is completed, the carriage 5 can pass onto the frame 17 to quilt the new cloth.

It should be noted that during the transfer of the carriage 5 onto the frame 17, in order to avoid interference between the jacks 21, 22 and the beam 8 which supports the crochet devices, said jacks 21, 22 are alternatively raised and lowered to allow the passage of the beam 8, while the frame remains constantly supported. For example, when the carriage 5 must move to the right, the jacks 21 are lowered and the jacks 22 are raised. When the beam 8 has passed beyond the jacks 21, said jacks 21 are raised and the jacks 22 are lowered to allow the approach of the carriage to the frame 17. The supporting jacks of said frame 17 are activated similarly to allow the advancement of the carriage onto the frame 17 and perform the quilting of the previously applied cloth.

As can be seen, the deadtimes of the apparatus are practically reduced to the times required for the transfer of the carriage 5 from one frame to the other, so as to provide a high increase in productivity.

Figure 2:
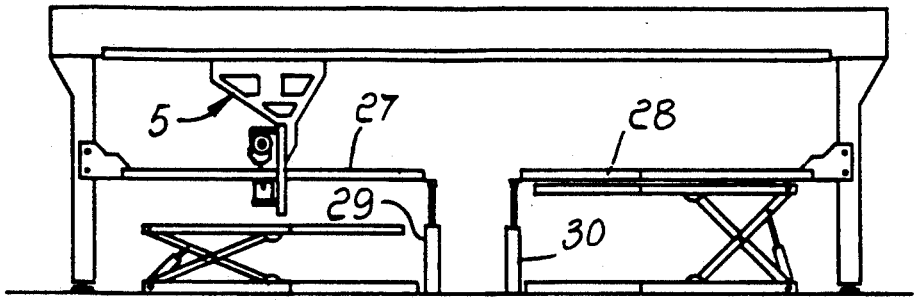
FIGS. 2, 3 and 4 are views of further embodiments of the quilting apparatus according to the present invention.

In the embodiment of FIG. 2, the cloth-holding frames 27, 28 are mounted in a cantilever manner on the uprights 2 of the framework and are supported, at their adjacent ends, by individual jacks 29, 30. In this manner the passage of the carriage 5 from one frame to the other entails the alternation of the actuation (lifting and lowering) of the jacks 29, 30.

Figure 3:
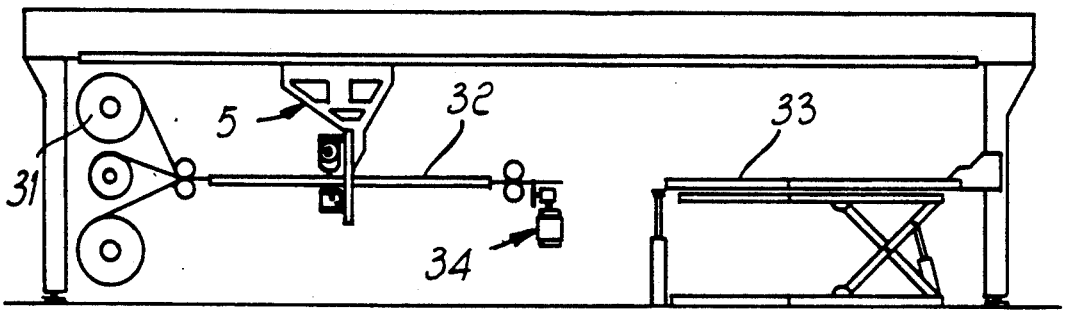

The apparatus can also be used on cloths which are unrolled to preset lengths from one or more reels 31 in a direction which is parallel to the sliding direction of the carriage 5, as illustrated in FIG. 3. Such an embodiment has two frames 32, 33 which are mounted in a cantilever manner, like the frames 27 and 28 of FIG. 2, and a cloth cutting device 34 which is structured so as to allow the passage of the carriage 5 from one frame to the other.

Figure 4:
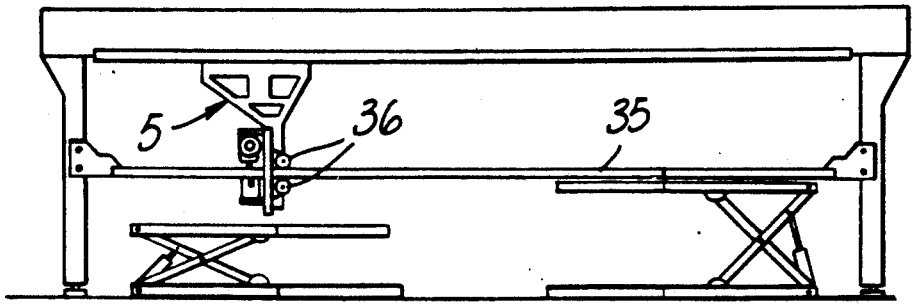

In another embodiment, illustrated in FIG. 4, it is possible to install two frames 35 which are mutually connected so as to form a single frame. In this case the application of the frame supporting jacks is no longer required. To avoid the forming of excessive deflection at the center of the frame, said frame is supported laterally, in a sliding manner, by means of rollers 36, by the carriage 5 itself.

The described apparatus can be advantageously provided with a remote control device capable of controlling the movement of the carriage and of the sewing heads along the X and Y directions. Said device can be programmed to automatically perform quilting according to a given pattern or can be guided by an operator.

In order to more clearly visualize the path of the needle in case of operator guiding, there is a TV camera which is aimed at the needle work area and is mounted rigidly with the sewing head; said camera is connected to a monitor so as to allow the operator to check the movements of the carriage and of the sewing heads by means of said control device.

What is claimed is:

1. Quilting apparatus, comprising a framework and a carriage guided thereon in a suspended manner, said carriage being slidable in a first direction and supporting one or more means for quilting comprising sewing heads and crochet devices operatively connected to said sewing heads and guided in a second direction which is substantially orthogonal to said first direction, at least two stationary and adjacent cloth-holding frames, said carriage being movable therebetween to quilt a cloth applied on either one of said frames, the apparatus further comprising means for the application of the cloth to be quilted onto said frames and means for the removal of quilted cloth, means for synchronizing movement of said carriage with movement of said means for applying and means for removing cloth so that when the carriage is at one of the two frames to perform quilting, said means for applying and means for removing cloth operate on the other frame.

2. Apparatus according to claim 1, wherein said carriage comprises two side walls, two beams mutually connecting said walls and slidingly supporting said sewing heads and crochet devices respectively, said frames extending between said beams at a level between said sewing heads and said crochet devices, means provided on said frames for engaging the cloth at lateral edges thereof, said frames having opposite ends and adjacent ends, fixed legs for supporting said opposite ends and jacks for supporting said adjacent ends, said jacks being activated to allow the passage of the supporting beam of the crochet devices during transfer of the carriage from a frame onto the adjacent one.

3. Apparatus according to claim 2, wherein said framework comprises four vertical uprights arranged according to the vertices of a rectangle and the opposite ends of said frames are connected to said vertical uprights.

4. Apparatus according to claim 1, wherein said means for the application of the cloth to be quilted comprise a table arranged below each frame and means actuating said table between a raised position, in which it is substantially coplanar with said frame, and a lowered position below said carriage.

5. Apparatus according to claim 4, wherein said actuating means comprise a pantograph system actuated by jacks.

6. Apparatus according to claim 1, wherein said means for the removal of the quilted cloths comprise a pair of carriages slidingly arranged on said framework on both sides of said carriage, each carriage comprising a vertically extendable element and a grip element applied to said extendable element.

7. Apparatus according to claim 1, wherein said adjacent ends of said frames are mutually connected so as to form a single frame, a roller being arranged on said carriage for laterally and slidingly supporting said single frame.

8. Apparatus according to claim 1, wherein a cloth-holding frame is preset for the application of cloths unrolled from reels, and means for cutting said unrolled cloths according to preset lengths being associated to said preset frame.

* * * * *